US006823867B2

(12) United States Patent
Avery et al.

(10) Patent No.: US 6,823,867 B2
(45) Date of Patent: Nov. 30, 2004

(54) POUCH FOR THE BLOWER UNIT OF A POWERED AIR PURIFYING RESPIRATOR

(75) Inventors: Martin J. Avery, Middlesex (GB); Raymond Odell, Hertfordshire (GB); Jason A. Graves, Berkshire (GB); Nicholas J. Gloag, Darlington (GB); Simon A. Mortimer, Berkshire (GB); Rachael J. Johnson, County Durham (GB); Desmond T. Curran, County Durham (GB)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/263,807

(22) Filed: Oct. 3, 2002

(65) Prior Publication Data

US 2003/0192541 A1 Oct. 16, 2003

Related U.S. Application Data

(63) Continuation-in-part of application No. 10/121,306, filed on Apr. 12, 2002, now abandoned.

(51) Int. Cl.[7] ..... A62B 18/02

(52) U.S. Cl. ..... 128/205.25; 128/200.24; 128/202.13; 128/204.18; 383/41; 383/60

(58) Field of Search ..... 128/200.24, 204.18–207.18, 128/201.19–201.23, 202.11, 202.13; 224/101, 163, 191; 383/41–61.5, 93, 97, 98, 106, 120; 206/363–370, 349, 438, 803, 828

(56) References Cited

U.S. PATENT DOCUMENTS 3,786,809 A * 1/1974 Kitrilakis ..... 128/205.26
4,620,538 A * 11/1986 Koegel et al. ..... 128/201.23
5,309,901 A 5/1994 Beaussant
5,339,806 A 8/1994 Beaussant et al.
2002/0112754 A1 * 8/2002 Gauger et al. ..... 135/128

FOREIGN PATENT DOCUMENTS

| | | |
|---|---|---|
| DE | 156463 | 9/1982 |
| EP | 0 211 914 B1 | 10/1988 |
| EP | 0 353 417 B1 | 11/1992 |
| FR | 2 565 662 | 12/1985 |

OTHER PUBLICATIONS

"3M Safety: 3M™ Spark Arrest Cover GVP–146 1/Case", downloaded from the internet at http://products3.3m.com/catalog/us/en001/safety/occ health safety/node HJG6J1LJOKg . . . , pp. 1–3, dated Dec. 29, 2003.

"Paraclete–PAPR Blower (C420) Pouch", downloaded from the internet at http://shop.yahoo.com/diamondback/parparpapblowc4.html, 1 page, dated Dec. 29, 2003.

* cited by examiner

*Primary Examiner*—Glenn K. Dawson
(74) *Attorney, Agent, or Firm*—Karl G. Hanson

(57) ABSTRACT

A pouch is provided for the blower unit of a powered air-purifying respirator system, to isolate the blower unit from hazardous material such as potentially-explosive dust or gas. The pouch has an opening at one end through which the blower unit can be inserted into the pouch, and is shaped at the other end to receive the blower unit. It also has air inlet openings positioned to register with air inlets of the blower and permit the connection of the filter cartridges thereto, and an air outlet opening positioned to register with the air outlet of the blower unit and permit the connection thereto of a breathing tube of the respirator system. When the blower unit is inside the pouch, seals at the pouch openings inhibit or prevent particulate or gaseous material from entering the pouch through the openings.

24 Claims, 10 Drawing Sheets

POUCH FOR THE BLOWER UNIT OF A POWERED AIR PURIFYING RESPIRATOR

CROSS-REFERENCE TO RELATED APPLICATION

This application is a continuation-in-part of pending application Ser. No. 10/121,306 filed Apr. 12, 2002, entitled PERSONAL CONTAINMENT SYSTEM WITH ISOLATED BLOWER, now abandoned, the entire disclosure of which is incorporated herein by reference.

The present invention relates to respirator systems of the type commonly known as powered air-purifying respirators (PAPRs).

A PAPR employs a blower to supply filtered air to a respiratory mask that is worn by the user. The blower and air filter(s) are often provided in a separate unit that is remote from the respiratory mask and connected to the latter by a breathing tube or hose. The blower unit may be designed to be carried by the wearer (for example, on a belt at the waist) and will then typically also include a battery pack and related electronic control units to provide an independent power supply for the blower. When a PAPR is in use, filtered air is supplied continuously by the blower to the respiratory mask under positive pressure and causes spent air within the mask to be expelled. A PAPR system is distinguished from a non-powered respirator in which filtered air is drawn into, and expelled from, the respiratory mask by the wearer's own breathing action.

PAPRs are often used in industrial applications where the respiratory hazards are well-defined and quantified. Those respiratory hazards might include, for example, harmful gases and particulate matter and, when they are anticipated, a PAPR can be configured before a user enters the hazardous environment. It is then very desirable that there is a high degree of flexibility in how the PAPR can be configured so that the user can select in advance not only the appropriate filters for the anticipated hazards but also the preferred blower unit, breathing tube and respiratory mask.

PAPRs are also used in emergency situations by emergency response units (e.g. police, fire and civil defence units). In those circumstances, there is a need to be able to configure (and, if necessary, adapt) a PAPR quickly so that it can cope with the demands of a particular situation.

PAPRs can be required to be used in environments for which so-called "intrinsically-safe" equipment is specified (that is, equipment that is protected to a prescribed level against the ingress of a potentially explosive material in the form of gas or dust). The purpose of this is to reduce the risk of an explosion due to sparks or heat that may be generated by components within the equipment and, in the case of the blower unit of a PAPR, intrinsic safety requirements are often addressed through the provision of a unit that has been specifically-designed for this purpose. Such specifically-designed units are, however, generally more expensive than standard blower units and, for the user, it would often be more attractive to be able to up-grade a standard blower unit, provided it is dust-free (i.e. has not already been exposed to a contaminated environment) quickly and easily to an intrinsically-safe level whenever required.

PAPRs can also be required to be used in environments containing contaminating materials (for example, chemical or biological contaminants). In those cases, the PAPR must either be carefully disposed of after use (which is expensive and undesirable for environmental reasons), or carefully cleaned to remove the contaminating material. The latter course, although potentially less expensive, is time-consuming and it would clearly be advantageous if the cleaning time could be reduced. Alternatively, in the case in which the user of a PAPR is required to wear some form of protective clothing (e.g. a protective suit), it is also known to place the blower unit and breathing tube of the PAPR inside the suit although it is then less accessible. WO01/74449, for example, describes a protective suit having a harness-borne pump unit positioned inside the suit.

The present invention is concerned with enabling the blower unit of a PAPR (provided it has not already been contaminated) to be upgraded to an intrinsically-safe level quickly and easily and at comparatively low cost. It is further concerned with enabling the time required to clean a PAPR after use in a contaminated environment to be reduced.

In accordance with the invention, a pouch is provided into which the blower unit can be placed with a view to preventing the unit from being exposed to a particular hazardous material or with a view to preventing the entry of a particular hazardous material into the unit.

The present invention provides a pouch for the blower unit of a powered air-purifying respirator system, the blower unit being of a type comprising:

(a) an air inlet to which a filter cartridge can be detachably-connected, (b) an air outlet to which a breathing tube of the respirator system can be detachably-connected, and (c) a blower operable to draw air into the unit through the air inlet and to deliver filtered air to the air outlet;

wherein the pouch comprises;

(i) a closable main opening through which the blower unit can be inserted into the pouch, (ii) an air inlet opening positioned to register with the air inlet of the blower and permit the connection of the filter cartridge thereto, (iii) an air outlet opening positioned to register with the air outlet of the blower unit and permit the connection of the breathing tube thereto, and (iv) respective sealing means for each of the said openings;

the sealing means being so configured that, when the blower unit is located inside the closed pouch and is connected into the respirator system, they inhibit or prevent the passage of particulate or gaseous material into the pouch through the said openings.

The present invention also provides a method of protecting the blower unit of a powered air-purifying respirator system against the entry into the unit of particulate or gaseous material, the blower unit being of a type comprising:

(a) an air inlet to which a filter cartridge can be detachably-connected, (b) an air outlet to which a breathing tube of the respirator system can be detachably-connected, and (c) a blower operable to draw air into the unit through the air inlet and to deliver filtered air to the air outlet;

the method comprising the steps of;

(i) placing the blower unit inside a pouch, (ii) connecting the air inlet to the filter cartridge through an opening in the pouch, (iii) connecting the air outlet to the breathing tube through an opening in the pouch, and (iv) providing sealing means at the openings in the pouch to inhibit or prevent the passage of particulate or gaseous material into the pouch through the said openings.

The present invention further provides a respirator system comprising:

a respiratory mask, a blower unit having an air inlet, an air outlet and a blower operable to draw air into the unit through the air inlet and to air to the air outlet, a pouch within which the blower unit is located, a filter cartridge detachably-connected to the air inlet of the blower unit through an opening in the pouch, and a breathing tube detachably-connected at one end to the air outlet of the blower unit through an opening in the pouch, and connected at the other end to the respiratory mask;

respective sealing means for each of the said openings; wherein the openings in the pouch are provided with sealing means that inhibit or prevent the passage of particulate or gaseous material into the pouch through the said openings.

Pouches have previously been provided for PAPR blower units to protect the casings of the units against damage (e.g. being scratched or otherwise marked) during use. A pouch of that type would not inhibit or prevent the passage of particulate or gaseous material into the blower unit and would not enable the blower unit of a PAPR (provided it has not already been contaminated) to be upgraded to an intrinsically-safe level.

By way of example, an embodiment of the invention will be described with reference to the accompanying drawings, in which.

Figure 1:
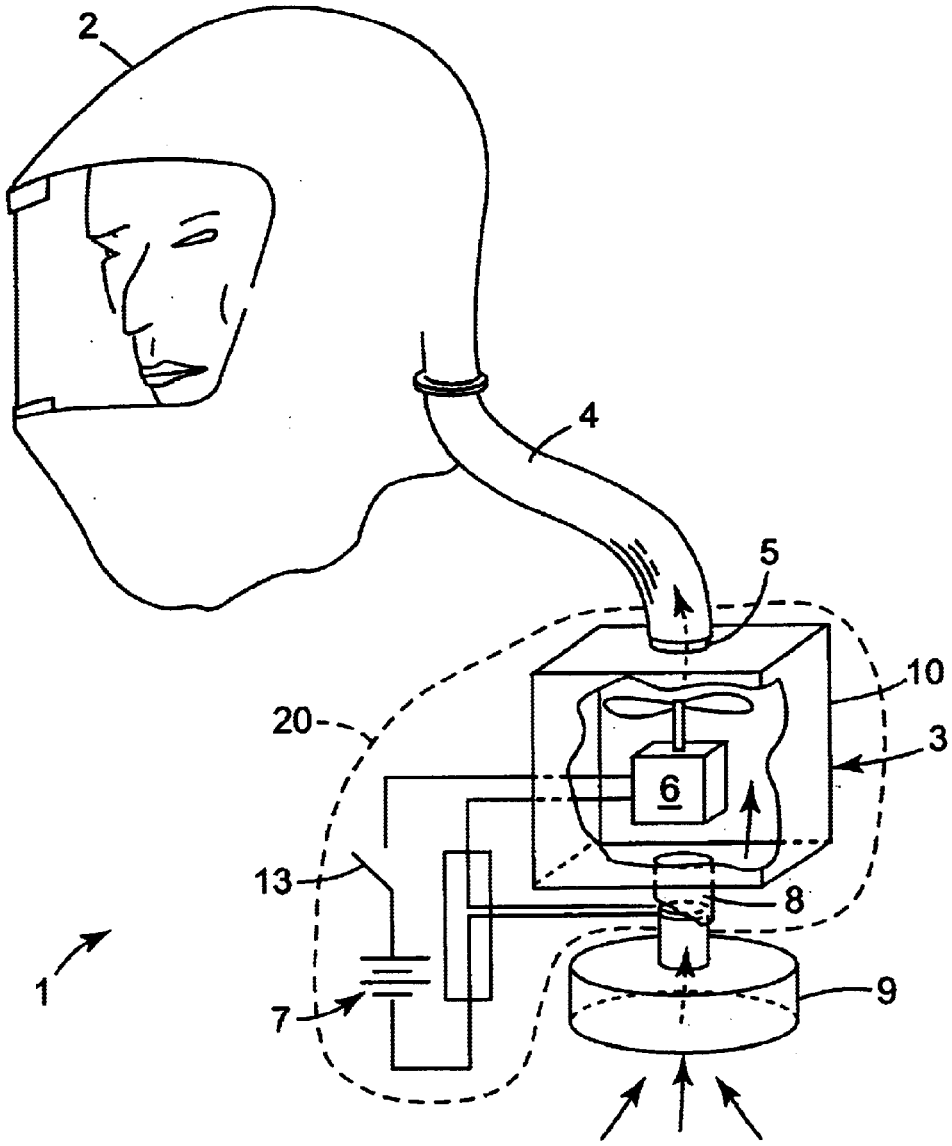
FIG. 1 is a diagram of a powered air-purifying respirator (PAPR) system.

FIG. 1 illustrates diagrammatically the main components of a powered air purifying respirator (PAPR) system 1. The system includes a respiratory mask 2 (which is illustrated as a hood but could be of any suitable type) and a blower unit 3 that supplies filtered air to the mask through a breathing tube 4 connected to the air outlet 5 of the unit. The blower unit 3 comprises a blower 6 powered by an electrical source 7 (typically a battery pack that is contained within the unit 3), and has at least one air inlet 8 to which a filter cartridge 9 is attached.

In use, the blower 6 draws air into the unit 3 through the filter 9 at the air inlet 8, and delivers the filtered air continuously to the respiratory mask 2 via the breathing tube 4, as indicated by the arrows. Spent air within the mask 2 is expelled, for example through a suitably-positioned vent, duct or valve (not shown), by the incoming filtered air which enters the mask at a positive pressure relative to the ambient pressure in the environment in which the PAPR is being used. The or each filter cartridge 9 is removably-attached to the blower unit 3 so that it can be replaced when its useful life expires.

Figure 2:
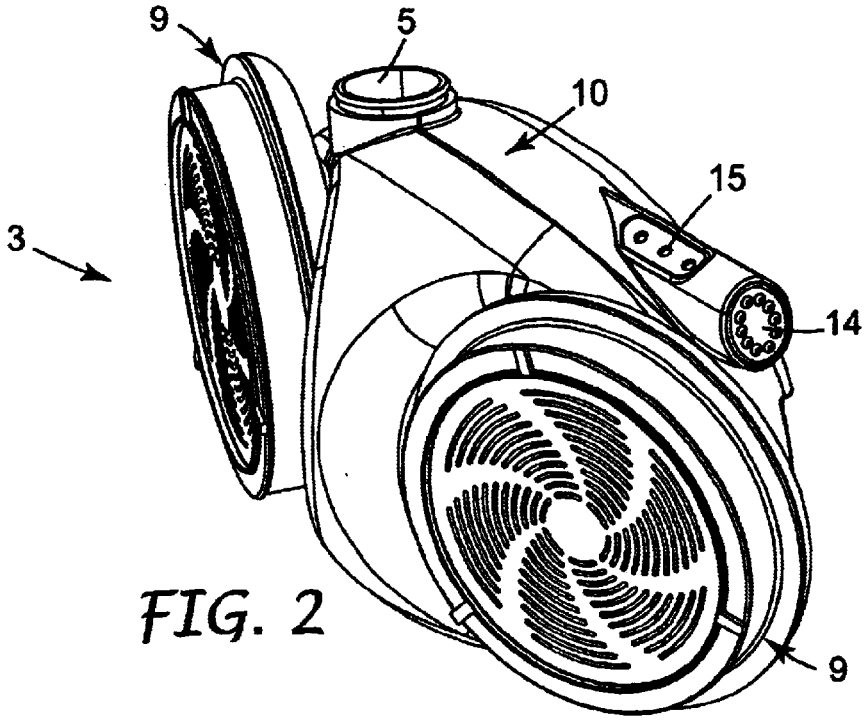
FIG. 2 is a perspective view from the front of one form of blower unit for a PAPR system.
Figure 3:
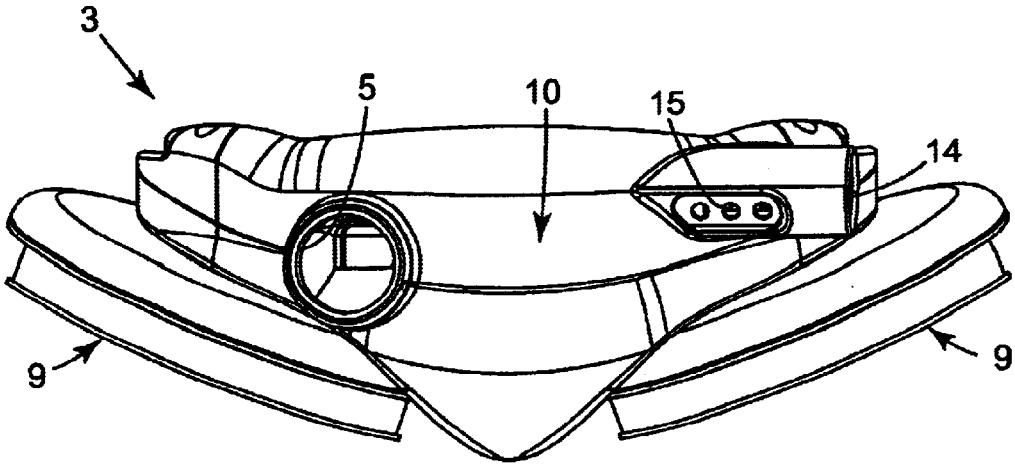
FIG. 3 is a top view of the blower unit.
Figure 4:
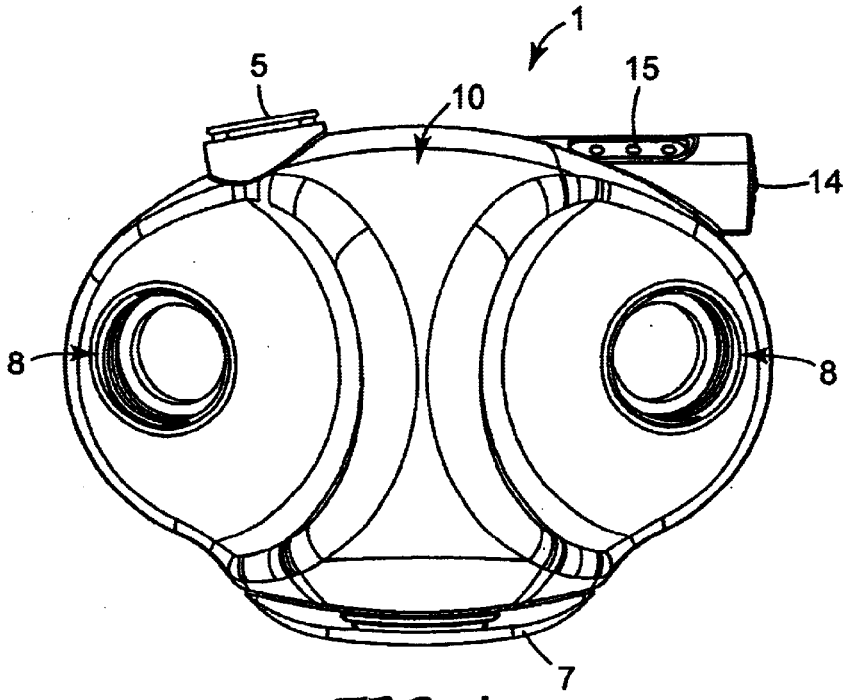
FIG. 4 is a front view of the blower unit, from which the filter cartridges have been removed.

One form of blower unit 3 suitable for use in a PAPR system is shown in FIGS. 2 to 5. The unit has a housing 10 on the front of which are two air inlets 8 (FIG. 4) to which, in use, are attached respective filter cartridges 9 (FIGS. 2 and 3). The air outlet 5 is located at the top of the blower unit 3 and is provided with a connection 11 (shown only in FIG. 5) for the attachment of the breathing tube 4 (not shown in FIGS. 2 to 5).

A compartment 12 (FIG. 5) is provided at the bottom of the housing 10 to receive and retain a battery pack 7 (FIG. 4) for supplying power to the blower 6 under the control of a switch 13 (see FIG. 1). The switch 13 is operated by means of an on/off button 14 at one side of the housing 10 and, in a neighbouring location, a panel 15 of indicator lights is provided to confirm to the user that the blower unit 3 is functioning correctly.

Figure 5:
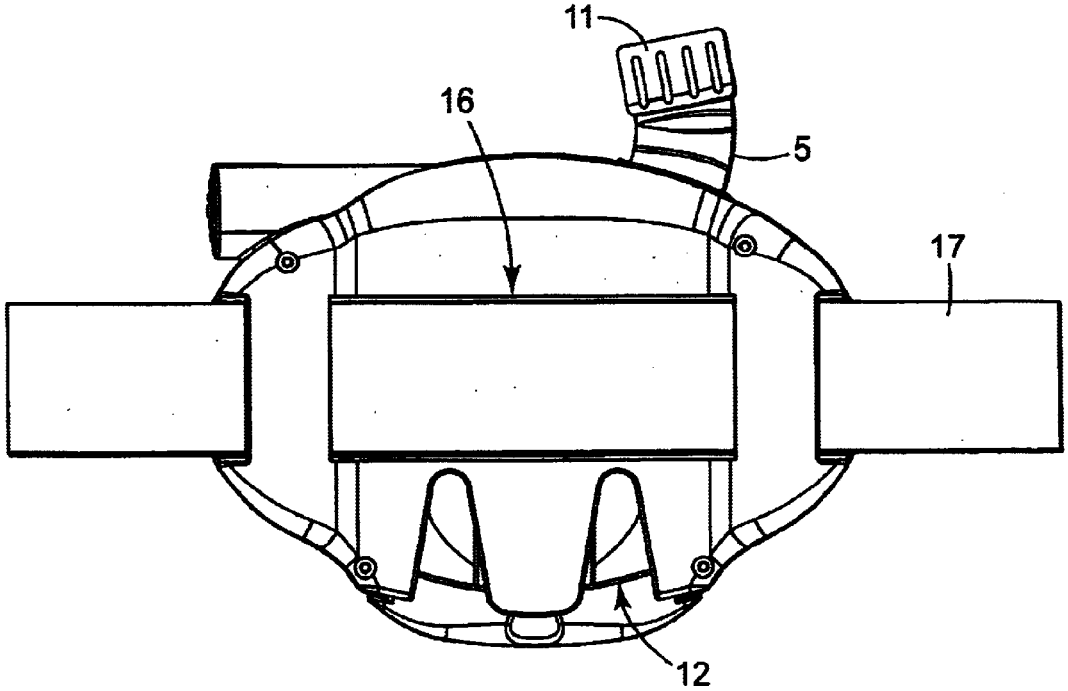
FIG. 5 is a back view of the blower unit, the unit being shown mounted on a belt.
Figure 6:
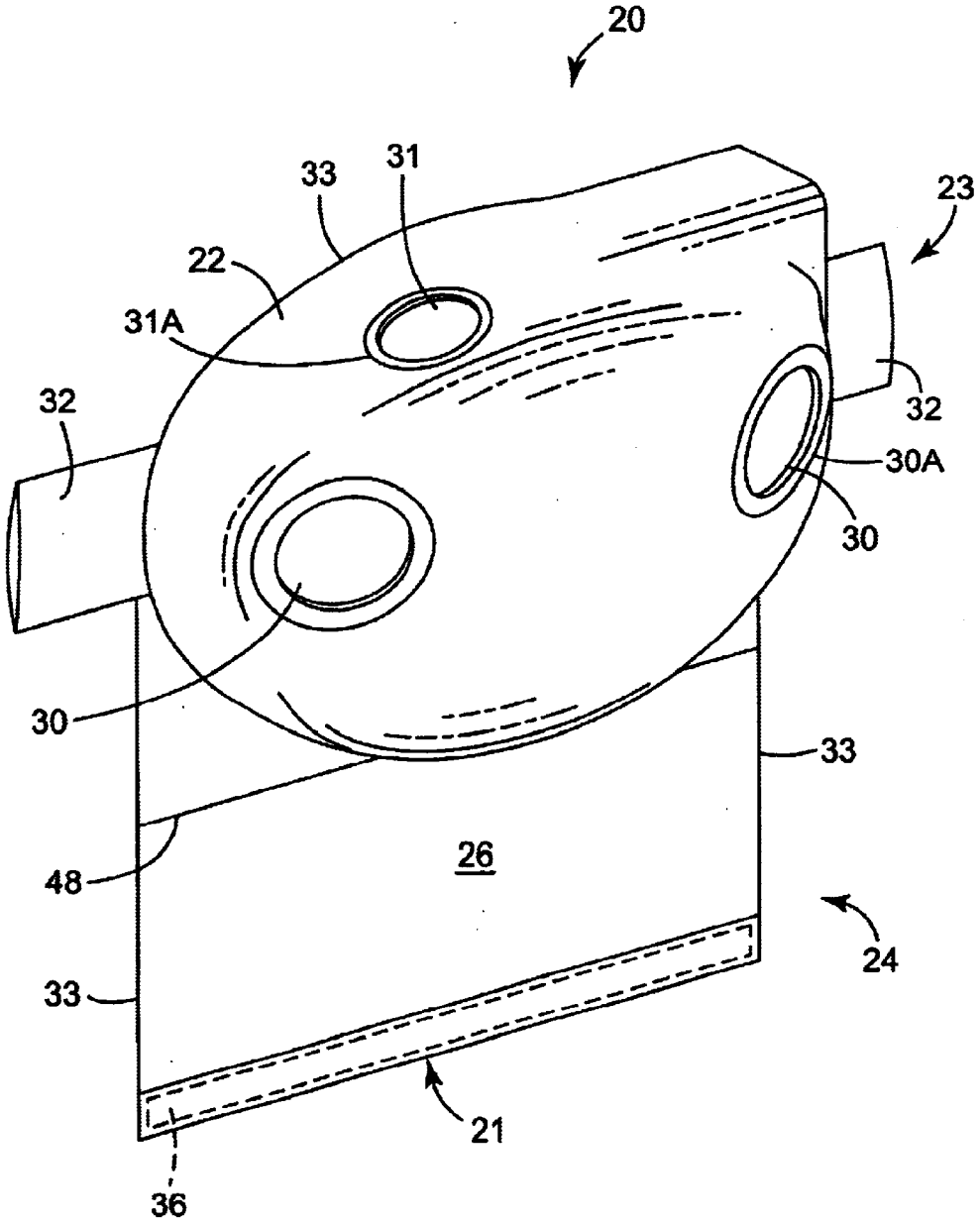
FIG. 6 is a perspective view from the front of a pouch for the blower unit of FIG. 2.
Figure 7:
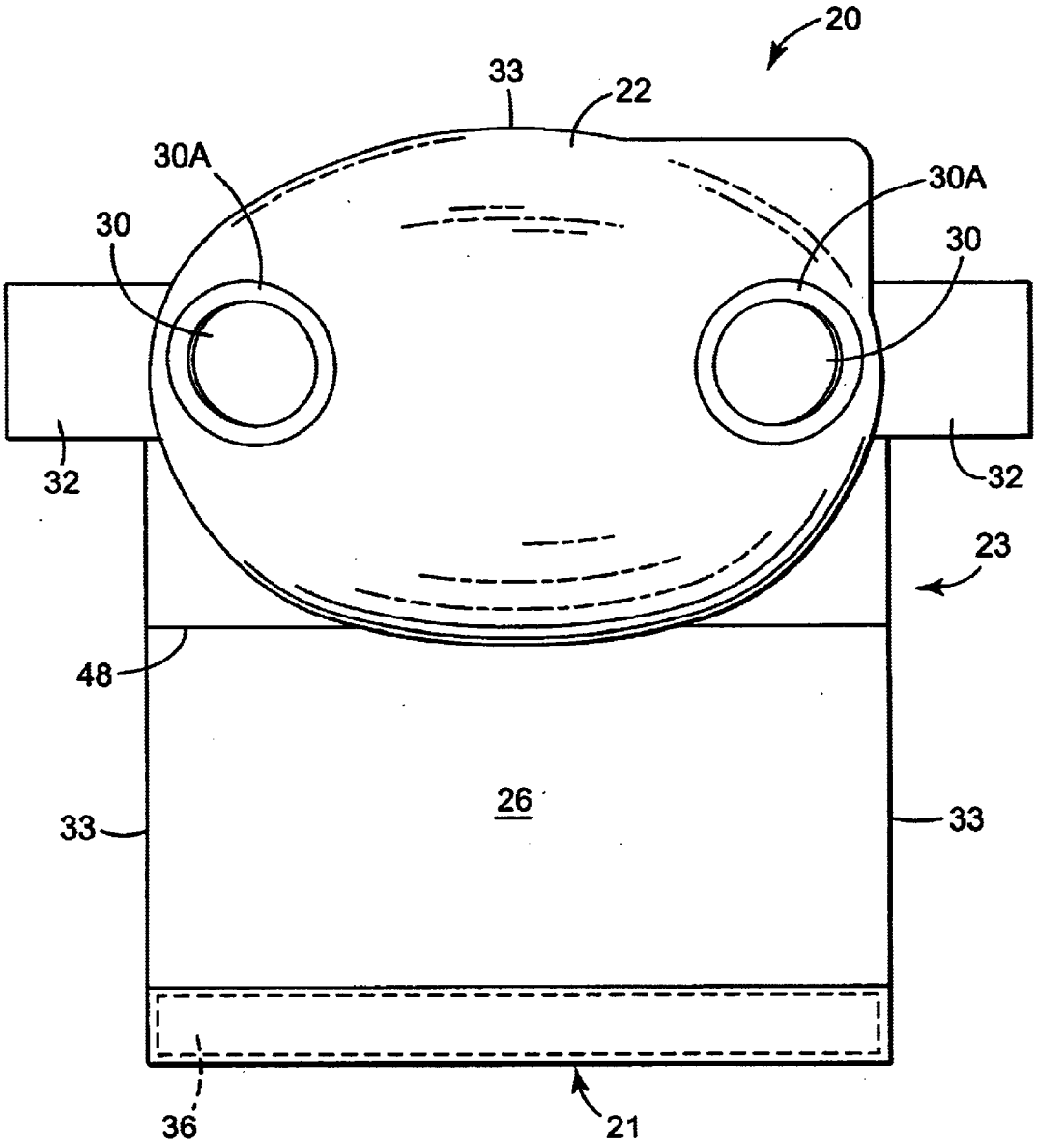
FIG. 7 is a front view of the pouch.
Figure 8:
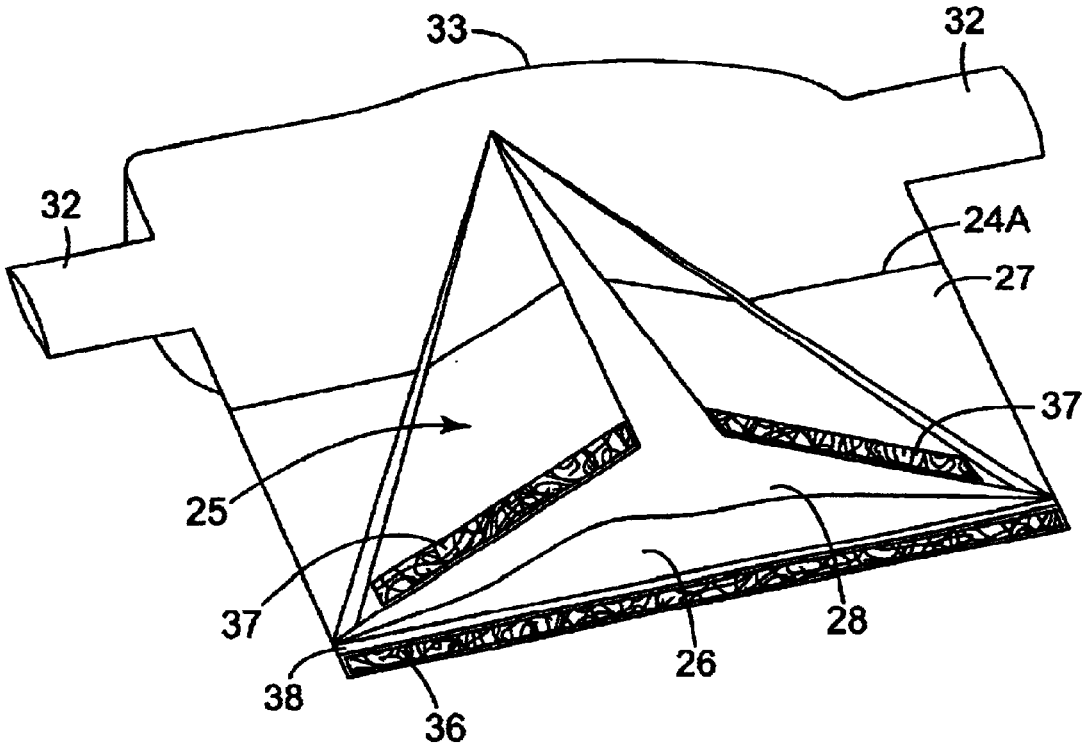
FIG. 8 is a perspective view of the pouch from the back, the pouch being shown partly-open.
Figure 9:
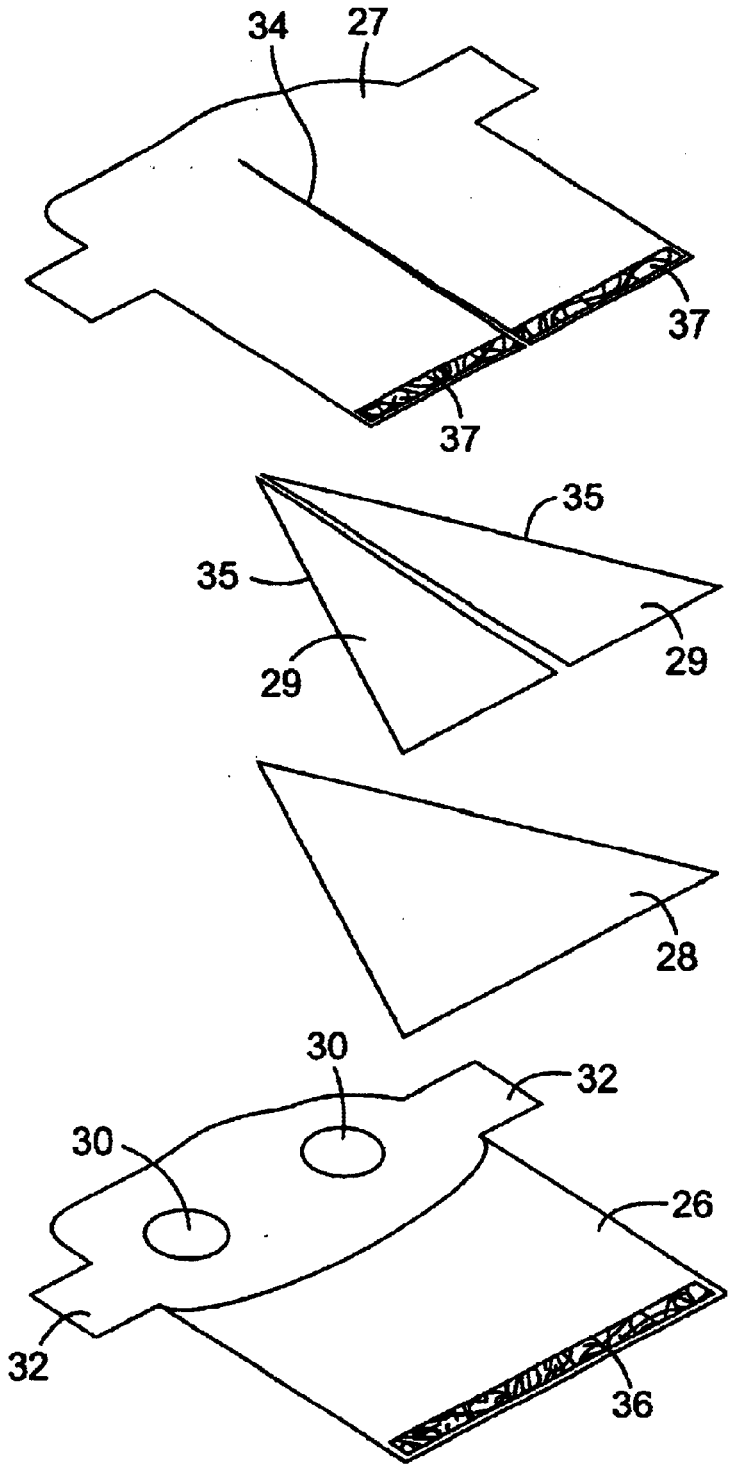
FIG. 9 is an exploded view of the pouch, showing (on a smaller scale) the various layers from which the pouch is assembled.
Figure 10:
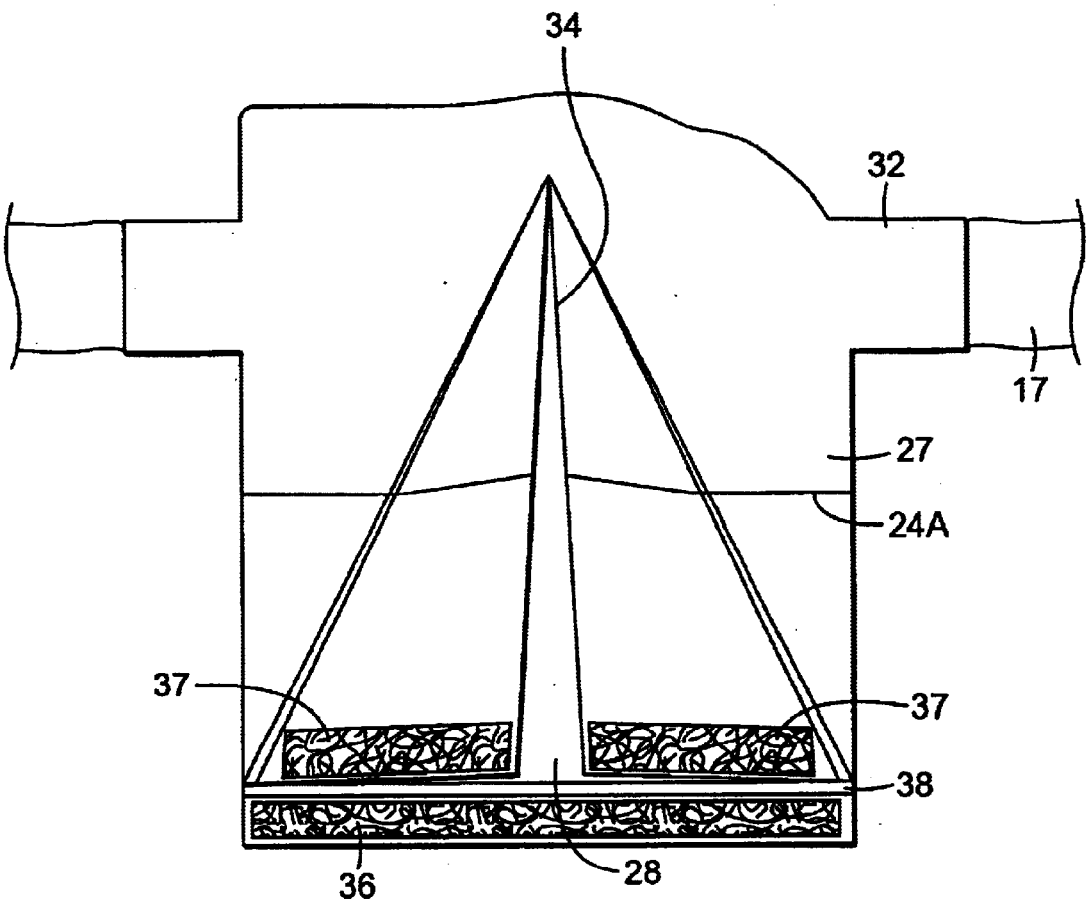
FIGS. 10 and 11 are, respectively, a back view and a side view of the pouch illustrating a step in the process of closing the pouch.
Figure 11:
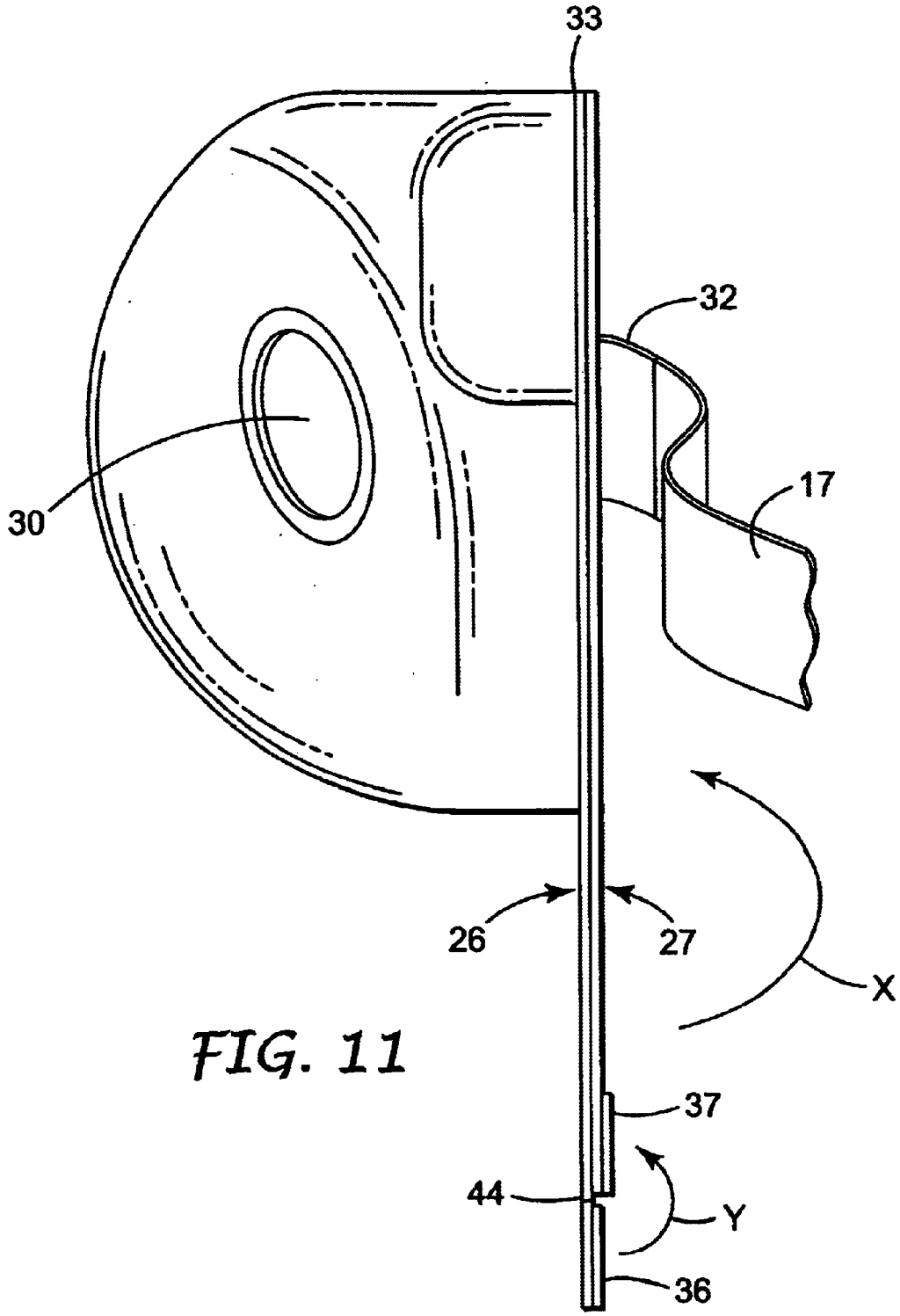
Figure 12:
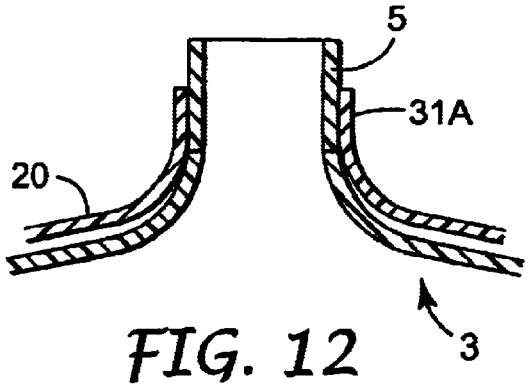
FIG. 12 is a diagrammatic cross-section of a seal between the pouch and the air outlet of the blower unit.

A belt track 16 is formed in the back of the housing 10 to receive a belt 17, as shown in FIG. 5, by means of which the blower unit 3 can be mounted at the user's waist, typically at the back of the body. For maximum comfort, the belt 17 is intended to be attached to a second belt (not shown) shaped to provide increased support for the blower unit 3 adjacent the wearer's back. As can be seen from FIGS. 3 and 5, the back of the blower unit (which, in use, would be adjacent the back of the user) is generally flat.

As stated above, the filter cartridges 9 are removably-attached to the blower unit 3 so that they can be replaced when their useful life expires. In use, each filter cartridge 9 is sealingly-engaged in the respective air inlet 8 of the housing 10 by means of a threaded connection, preferably one that permits rapid connection of the cartridge to the blower unit 3. Advantageously, the threaded connection is supplemented by a click-lock feature that prevents accidental disengagement of the filter cartridge from the blower unit and also provides an indication to the user that the cartridge has been properly installed.

A blower unit of the type shown in FIGS. 2 to 5 is described in greater detail in WO 02/11815 to which reference may be made for further information if required. For the purposes of the present invention, the internal configuration of the blower unit 3 is not significant, it being sufficient only that the unit will function as already described to draw air in through the filters 9 and deliver filtered air to the outlet 5. A suitable blower unit is available from 3M Company and is sold in the United Kingdom under the trade designation JUPITER™. Another suitable blower unit is available from Safety Equipment Australia under the trade designation SE400AT™. The blower unit can also be equipped with a sealed port that provides a generally fluid tight connection to the blower during filter replacement, as described in U.S. patent application Publication No. U.S. 2003/0192537 A1, entitled PERSONAL CONTAINMENT SYSTEM WITH SEALED PASSTHROUGH, filed Sep. 3, 2002, the entire disclosure of which is incorporated herein by reference. The blower is preferably used together with a personal protective suit equipped with a partial flow restriction between the hood portion and body portion of the suit as described in U.S. patent application Publication No. U.S.

2003/0192103 A1, entitled PERSONAL PROTECTIVE SUIT WITH PARTIAL FLOW RESTRICTION, filed Sep. 3, 2002, the entire disclosure of which is incorporated herein by reference.

In normal use, the blower unit 3 is mounted at the waist of the PAPR user, as already described, and will be exposed to the environment in which the user finds himself. The filter cartridges 9 are selected, taking account of that environment, to ensure that they will remove any respiratory hazards from the air that is drawn into the unit 3 by the blower 6. In certain circumstances, however, it is desirable (and, in some cases, essential) to be able to protect the blower unit 3 from the environment in which the PAPR user finds himself and a method by which that may be achieved will be described below. One circumstance in which protection of the unit 3 from the environment may be essential is when the environment contains a potentially explosive substance (gas or dust) which should not be allowed to come into proximity with, for example, the electrical components within the unit, for example via the battery compartment 12. A circumstance in which isolation of the unit 3 from the environment may be highly desirable is when the environment contains a contaminant (e.g. a chemical or a biological substance) that would necessitate thorough cleaning of the unit 3 if the latter were exposed to it during use.

In accordance with the present invention, protection of the blower unit 3 from the environment in which it is being used is achieved by placing the unit inside a pouch which, when closed, forms a sealed enclosure around the unit. The pouch 20 is indicated diagrammatically in dotted lines in FIG. 1. A pouch 20 that is suitable for use with the blower unit of FIGS. 2 to 5 will now be described with reference to FIGS. 6 to 12.

The pouch 20 is formed from a flexible polymeric material. The material is transparent but, for clarity, is illustrated in the drawings as if it were opaque so that features that would normally be visible through the pouch do not appear. The pouch 20 has the general form of an elongate bag open at its lower end 21 and closed at its upper end 22. The upper part 23 of the pouch 20, adjacent the closed end 22, has a shape that corresponds to the external shape of the blower unit while the lower part (or skirt) 24 is generally flat when the pouch is in an un-opened condition. A V-shaped pleat 25 is formed in the back of the pouch (see FIG. 8) to facilitate the insertion of the blower unit 3, as will be described below.

The pouch 20 comprises a front panel 26 and a back panel 27, together with an internal front panel 28 and two internal back panels 29 (see FIG. 9) that are used to form the pleat 25. The upper part of the front panel 26 is shaped by thermo-forming to fit over the front, top and bottom surfaces of the housing 10 of the blower unit 3, including the on/off button 14 and the indicator panel 15, and has apertures 30 positioned to correspond to the location of the air inlets 8 of the blower unit, and an aperture 31 positioned to correspond to the location of the air outlet 5. A pneumatic seal 30A is formed around the periphery of each of the apertures 30, and the construction and purpose of these seals will be described in greater detail below. In addition, a raised lip 31A is formed in the pouch around the aperture 31, the purpose of which will also be described below.

Extending outwards from each side of the shaped upper part of the panel 26, along a line corresponding to that of the belt 17 of the blower unit, is a respective arm 32. The purpose of the arms 32, which have a width similar to that of the belt 17, will be described below.

The back panel 27 of the pouch 20 is flat, with a peripheral shape that corresponds to that of the front panel, to which it is joined (except at the lower end and at the outer ends of the arms 32) by a peripheral welded seam 33. To form the pleat 25, the back panel 27 of the pouch is slit from the lower edge almost to the top, as indicated at 34. The two internal back panels 29 (each in the shape of a right-angled triangle equivalent to one half of the internal front panel 28) are joined to the internal front panel 28 along their longest sides 35 and to the back panel 27 on each side of the slit 34. The joined internal panels 28, 29 are also secured to the back panel 27 at the top of the slit 34, thus forming the pleat 25.

The front panel 26 extends beyond both the back panel 27 and the internal panels 28, 29 at the lower end 21 of the pouch and, on the inside surface of the extension, carries a strip 36 that extends the width of the front panel and comprises one part of a hook-and-loop fastener. Strips 37 that constitute the other part of the hook-and-loop fastener are located along the lower end of each half of the back panel 27, on outer surface of the latter. Immediately above the strip 36 on the inside surface of the front panel 26 is a pneumatic seal 38, the construction of which will be described below. The purpose of the hook-and-loop fastener strips 36, 37 and the pneumatic seal 38 will be described below.

To insert the blower unit 3 into the pouch 20, the lower end 21 of the pouch (including the pleat 25) is opened up and the blower unit 3 (without the filter cartridges 9 and the belt 17) is pushed inside towards the upper end 22 of the pouch until it is correctly located in the shaped portion 23 with the air outlet 5 extending out of the top of the pouch through the aperture 31. In this position, the air inlets 8 of the blower unit will be aligned with the apertures 30 in the front panel of the pouch. The belt 17 is then threaded into the pouch through one of the arms 32, along the belt track 16 of the blower unit 3, and out through the other arm 32 so that it extends out of the pouch on both sides and can be used to mount the blower unit at the waist of the wearer in the normal way. The open end 21 of the pouch is then closed and sealed by means of the hook-and-loop closures 36, 37 and the pneumatic seal 38 as will be described below, and the skirt portion 24 is folded up behind the upper part of the back panel 27 of the pouch as indicated by the arrow X in FIG. 11. An indicator line 24A may be provided on the back panel 27 to show the preferred location of the fold, if desired. Filter cartridges 9 are attached to the air inlets 8 of the blower unit 3 from the outside of the pouch, and the blower unit can then be used in a PAPR in the normal way.

The on/off button 14 and the panel 15 of the blower unit 3 are both visible through the pouch, and the flexible nature of the pouch material enables the button 14 to be operated without difficulty. If access to the battery pack 7 is required at any time, there is no need to remove the blower unit 3 from the pouch, it being necessary only to open the end 21 of the pouch to access the compartment 12.

As described below, the construction of the pouch ensures that no undesirable particulate or gaseous materials (such as dust, fumes, vapours, or chemical/biological contaminants, depending on the circumstances) can enter the pouch at any point, particularly around the air outlet 5 of the blower unit; or around the belt 17; or around the air inlets 8 of the blower; or through the lower end 21 of the pouch.

To ensure that no undesirable material can enter the pouch 20 around the air outlet 5 of the blower unit 3, the aperture 31 in the pouch and the surrounding upstanding lip 31A are formed with a diameter that is slightly smaller than the external diameter of the air outlet. Consequently, the pouch material must be stretched to enable the air outlet to be inserted through the aperture 31 and will then shrink back, causing the lip 31A to form a seal against the external surface of the air outlet (see FIG. 12). Through an appropriate choice of the diameter of the aperture 31 and the height of the lip 31A, this seal can prevent the entry of particulate or gaseous contaminants into the pouch around the air outlet 5.

Figure 13:
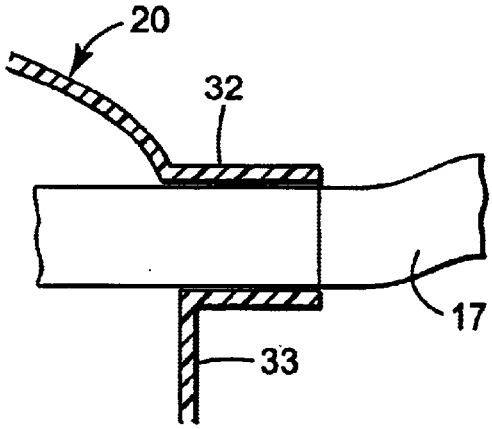
FIG. 13 is a diagrammatic illustration of another seal between the pouch and the belt of the blower unit.

Similarly, through an appropriate choice of the length of the arms 32 (provided that they are a snug fit around the belt 17, as shown in FIG. 13) the entry of particulate or gaseous contaminants into the pouch around the belt 17 can also be prevented. For example, when the belt 17 is 4 or 5 cms wide, it has been found that a length of 2 or 3 cms for the arms 32 is generally sufficient.

Figure 14:
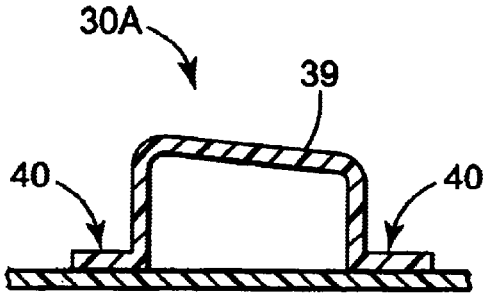
FIGS. 14 and 15 are cross-sections of pneumatic seals that are formed in the pouch.

To prevent the entry of undesirable material into the pouch around the air inlets 8 of the blower unit 3, the pneumatic seals 30A around the apertures 30 in the pouch are arranged to form a seal against the back surfaces of the filter cartridges 9 when the latter are attached to the blower unit from outside the pouch. An enlarged cross-section through one of the seals 30A is shown in FIG. 14. The seal comprises a ring 39 of polymeric material (typically, the same material as that used for the pouch) with a channel-shaped cross-section, which is placed around the respective aperture 30 of the front surface of the pouch so that it stands up from that surface. The margins 40 of the ring 39 are then secured to the pouch material, for example by welding, so that the ring forms an air-filled cushion around the aperture 30 and will seal against the back of the respective filter cartridge when the latter is attached to the blower unit 3.

Figure 15:
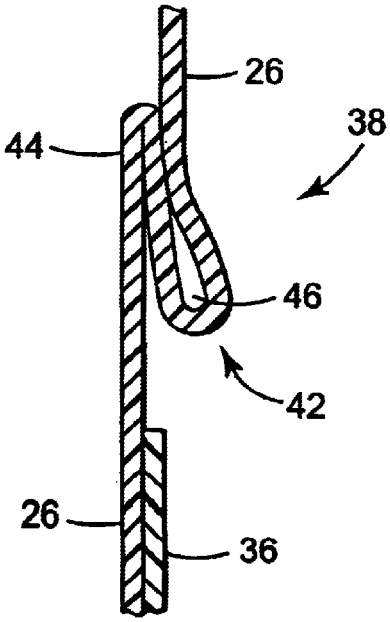

To prevent the entry of undesirable material into the pouch through the lower end 21, the pneumatic seal 38 is arranged to form a labyrinth seal within the skirt 24 of the pouch when the latter is closed. An enlarged cross-section through the seal 38 is shown in FIG. 15. The seal comprises a tuck 42 secured by a weld 44 in the material of the front panel 26 immediately above the fastener strip 36, the tuck resulting in the formation of a closed air-filled cushion of material 46 on the inside of the front panel 26. The pouch is closed in the following way after the blower unit 3 has been placed inside. The skirt 24 of the pouch is first flattened so that the front and back panels 26, 27 lie one on top of the other with the flattened pleat-forming layers 28, 29 between them. The lower extension of the front panel 26, carrying the fastener strip 36, is then folded backwards and upwards (as indicated by the arrow Y in FIG. 1l) along the weld 44, which functions as a hinge, and is pressed into engagement with the fastener strips 37 on the back of the pouch. The hook-and-loop fastener strips 36, 37 thus close the pouch 20 and trap the air-filled cushion 46 inside the folded lower end of the skirt 24, where it will contact the adjacent surfaces of the pouch and form a labyrinth seal to prevent the entry of undesirable material into the pouch at this end.

The pouch 20 is formed from any suitable polymeric material that can be thermo-formed to provide the shaped upper part of the front panel, and can be welded to form the seams between the various layers. As mentioned above, the pouch can be formed completely from a transparent material so that the whole of the blower unit 3 can be seen through the pouch. Alternatively, the pouch can be formed from an opaque material with transparent inserts so that only certain parts of the blower unit (especially the on/off switch 14 and the indicator panel 15) are visible. A suitable material for the pouch 20 is a polyurethane material and, if desired, the shaped upper part of the front panel can be formed from a thicker version of the material than the rest of the pouch to provide enhanced protection against damage for the outwardly-facing surfaces of the blower unit when the latter is in use. For example, the layers of the pouch may all be formed from a polyurethane ester material having a density of 1.15 g/cm3, except the shaped upper part of the front panel which has a density of 1.21 g/cm3 and a higher tear resistance. In that case, the shaped upper part 23 of the front panel would be welded to the skirt part 24, as indicated by the weld line 48 in FIGS. 6 and 7.

Through the use of a pouch as illustrated in FIGS. 6 to 11, a blower unit 3 that is not, in itself, intrinsically-safe can be provided with protection to a prescribed level against the ingress of a potentially explosive material in the form of gas or dust. Before the blower unit is inserted in the pouch it should not already be contaminated (e.g. previously exposed to dust) since that could render the pouch useless.

It will be appreciated that various modifications may be made to the pouch 20 without affecting its function. For example, the various layers of the pouch could be joined together in different ways and, in the case of the pleat 25, at least some of the seams could be replaced by folds. Also, alternative forms of seals and closures could be used to prevent the entry of undesirable materials into the pouch following insertion of the blower unit. For example, the filter cartridges 9 could be attached to the blower unit 3 in the manner described in the above-mentioned U.S. application Ser. No. 10/121306 filed 12 Apr. 2002.

The belt 17 could be attached to the pouch during assembly of the latter, or formed as an integral part of the front or rear panel 26, 27 of the pouch. Alternatively, instead of being carried on a belt at the waist of the user, the pouch could be formed as part of a garment (for example, a protective suit) that is worn by the user.

We claim:

1. A pouch and blower unit for a powered air-purifying respirator system, the blower unit being inside the pouch and of a type comprising:

(a) an air inlet to which a filter cartridge can be detachably-connected, (b) an air outlet to which a breathing tube of the respirator system can be detachably-connected, and (c) a blower operable to draw air into the unit through the air inlet and to deliver filtered air to the air outlet;

wherein the pouch comprises;

(i) a closable main opening through which the blower unit can be inserted into the pouch, (ii) an air inlet opening positioned to register with the air inlet of the blower and permit the connection of the filter cartridge thereto, (iii) an air outlet opening positioned to register with the air outlet of the blower unit and permit the connection of the breathing tube thereto, and (iv) respective seals for each of the said openings;

the seals being so configured that, when the pouch is closed with the blower unit located inside and connected into the respirator system, the seals inhibit or prevent the passage of particulate or gaseous material into the pouch through the said openings.

2. A pouch and blower unit as claimed in claim 1, wherein the seal of the air inlet opening surrounds the inlet opening and is arranged to seal against the filter cartridge.

3. A pouch and blower unit as claimed in claim 2, wherein the seal of the air inlet opening comprises an air-filled cushion.

4. A pouch and blower unit as claimed claim 1, wherein the air outlet opening is shaped to fit around, and seal to, an outlet connection extending from the air outlet of the blower unit.

5. A pouch and blower unit as claimed in claim 1, in which the blower unit includes a compartment for a battery-pack for supplying power to the blower, the compartment being accessible through the main opening of the pouch.

6. A pouch and blower unit as claimed in claim 1, the pouch being formed from a material that enables a control switch of the blower unit to be operated from outside the pouch through the material.

7. A pouch and blower unit as claimed in claim 1, the pouch being formed from a material through which the controls and indicators of the blower unit are visible.

8. A pouch and blower unit as claimed in claim 1, in which the said other end of the pouch has a shape that corresponds to tie shape of the blower unit.

9. A pouch and blower unit claimed in claim 1, the pouch being shaped for mounting on a belt by which the blower unit can be positioned at the waist of a user.

10. A method of protecting the blower unit of a powered air-purifying respirator system against the entry into the unit of particulate or gaseous material, comprising the step of placing the unit inside a pouch as claimed in claim 1.

11. A powered air-purifying respirator system comprising:

a respiratory mask, a blower unit having an air inlet, an air outlet and a blower operable to draw air into the unit through the air inlet and to deliver air to the air outlet, a filter cartridge detachably-connected to the air inlet of the blower unit, and a breathing tube detachably-connected at one end to the air outlet of the blower unit, and connected at the other end to the respiratory mask;

wherein the blower unit of the system is located inside a pouch as claimed in claim 1 to inhibit or prevent the passage of particulate or gaseous material into the blower unit.

12. A pouch for the blower unit of a powered air-purifying respirator system the blower unit being of a type comprising:

(a) a housing, (b) an air inlet to which a filter cartridge can be detachably-connected, (c) an air outlet to which a breathing tube of the respirator system can be detachbly-connected, and (d) a blower inside the housing operable to draw air into the unit through the air inlet and to deliver filtered air to the air outlet;

wherein the pouch comprises:

(i) a closable main opening located at one end of the pouch, through which the blower unit can be inserted into the pouch, (ii) an air inlet opening positioned to register with the air inlet of the blower and permit the connection of the filter cartridge thereto, (iii) an air outlet opening positioned to register with the air outlet of the blower unit and permit the connection of the breathing tube thereto, and (iv) respective seals for each of the said openings;

the other end of the pouch being closed and shaped by thermo-forming to receive the blower unit and fit over the housing, said other end including the said air inlet and outlet openings, with the seals being so configured that, when the pouch is closed with the blower unit located inside and connected into the respirator system, the seals inhibit or prevent the passage of particulate or gaseous material into the pouch through the said openings.

13. A pouch as claimed in claim 12, in which the said one end of the pouch is folded to form a labyrinth seal against the entry of particulate or gaseous material into the pouch.

14. A pouch as claimed in claim 13, in which the said one end of the pouch is provided with a hook-and-loop fastener for closing the open end and holding it when folded.

15. A pouch as claimed claim 13, which the labyrinth seal includes a seal in the form of an air cushion.

16. A pouch as claimed in claim 12, the pouch being formed from a polyurethane material.

17. A pouch for the blower unit of a powered air-purifying respirator system, the blower unit being of a type comprising:

(a) an air inlet to which a filter cartridge can be detachably-connected, (b) an air outlet to which a breathing tube of the respirator system can be detachably-connected, and (c) a blower operable to draw air into the unit through the air inlet and to deliver filtered air to the air outlet;

wherein the pouch comprises:

(i) a closable main opening located at one end of the pouch, through which the blower unit can be inserted into the pouch, (ii) an air inlet opening positioned to register with the air inlet of the blower and permit the connection of the filter cartridge thereto, (iii) an air outlet opening shaped to fit around and seal to, an outlet connection extending from the air outlet of the blower unit, the air opening being stretched around the outlet connection and Positioned to register with the air outlet of the blower unit and permit the connection of the breathing tube thereto, and (iv) respective seals for each of the said openings;

the seals being so configured that when the pouch is closed with the blower unit located inside and connected into the respirator system, the seals inhibit or prevent the passage of particular or gaseous material into though through the said openings.

18. A pouch for the blower unit of a powered air-purifying respirator system, the blower unit being of a type comprising:

(a) an air inlet to which a filter cartridge can be detachably-connected, (b) an air outlet to which a breathing tube of the respirator system can be detachably-connected, and (c) a blower operable to draw air into the unit through the air inlet and to deliver filtered air to the air outlet;

wherein the pouch comprises;

(i) a closable main opening located at one end of the pouch, through which the blower unit can be inserted into the pouch.

(ii) an air inlet opening positioned to register with the air inlet of the blower and permit the connection of the filter cartridge thereto, (iii) an air outlet opening positioned to register with the air outlet of the blower unit and permit the connection of the breathing tube thereto, and (iv) respective seals for each of the said opening;

in which at least one pleat is formed in the main opening to facilitate the insertion of the unit into the pouch, the other end of the pouch being closed and shaped to receive the blower unit and including the said air inlet and outlet openings, with the seals being so configured that, when the pouch is closed with the blower unit located inside and connected into the respirator system, the seals inhibit or prevent the passage of particulate or gaseous material into the pouch through the said openings.

19. A pouch as for the blower unit of a powered air-purifying respirator system, the blower unit being of a type comprising:

(a) an air inlet to which a filter cartridge can be detachably-connected, (b) an air outlet to which a breathing tube of the register system can be detachably-connected, and (c) a blower operable to draw air into the unit through the air inlet and to deliver filtered air to the air outlet;

wherein the pouch comprises:

(i) a closable main opening through which the blower unit can be inserted into the pouch, (ii) an air inlet opening positioned to register with the air inlet of the blower and permit the connection of the filter cartridge thereto, (iii) an air outlet opening positioned to register with the air outlet of the blower unit and permit the connection of the breathing tube thereto, and (iv) respective seals for each of the said openings;

the pouch being shaped for mounting on a belt by which the blower unit can be positioned at the waist of a user and formed with entry and exit openings for the belt, the belt openings being shaped to receive and to fit around the belt and being elongated to prevent the entry of particulate or gaseous material into the pouch when the latter is mounted on the belt, and the seals being so configured that, when the pouch is closed with the blower unit located inside and connected into the respirator system, the seals inhibit or prevent the passage of particulate or gaseous material into the pouch through the said openings.

20. A method of protecting the blower unit of a powered air-purifying respirator system against the entry into the unit of particulate or gaseous material, the blower unit being of a type comprising:

(a) an air inlet to which a filter cartridge can be detachably-connected, (b) an air outlet to which a breathing tube of the respirator system can be detachably-connected, and (c) a blower operable to draw air into the unit through the air inlet and to deliver filtered air to the air outlet;

the method comprising the steps of;

(i) placing the blower unit inside a pouch, (ii) connecting the air inlet to the filter cartridge through an opening in the pouch, (iii) connecting the air outlet to the breathing tube through an opening in the pouch, and (iv) providing seals at the openings in the pouch to inhibit or prevent the passage of particulate or gaseous material into the pouch through the said openings.

21. A respirator system comprising:

a respiratory mask, a blower unit having an air inlet, an air outlet and a blower operable to draw air into the unit through the air inlet and to deliver air to the air outlet, a pouch within which the blower unit is located, a filter cartridge detachably-connected to the air inlet of the blower unit through an opening in the pouch, and a breathing tube detachably-connected at one end to the air outlet of the blower unit through an opening in the pouch, and connected at the other end to the respiratory mask;

wherein the openings in the pouch are provided with seals that inhibit or prevent the passage of particulate or gaseous material into the pouch through the said openings.

22. A system as claimed in claim 21, in which the air outlet of the blower unit comprises a connection member that extends through the pouch and is connected to the breathing tube.

23. A system as claimed in claim 21, in which a battery pack for powering the blower unit can be accessed by opening the pouch but without removing the blower unit therefrom.

24. A system as claimed in claim 21, in which the pouch and blower unit are mounted on a belt by which the blower unit can be positioned at the waist of the wearer.

* * * * *

UNITED STATES PATENT AND TRADEMARK OFFICE

CERTIFICATE OF CORRECTION

PATENT NO. : 6,823,867 B2
APPLICATION NO. : 10/263807
DATED : November 30, 2004
INVENTOR(S) : Martin J. Avery It is certified that error appears in the above-identified patent and that said Letters Patent is hereby corrected as shown below:

Cover Page, References Cited, U.S. Patent Documents

| | | |
|---|---|---|
| 3,064,488 | 11/20/1962 | A.L. Lee et al. |
| 3,446,420 | 05/1969 | Rinecker |
| 3,525,334 | 08-25-1970 | Braman et al. |
| 3,768,467 | 10/1973 | Jennings |
| 3,777,750 | 12-11-1973 | Savornin |
| 4,172,454 | 10/30/1979 | Warncke et al. |
| 4,272,851 | 06-16-1981 | Goldstein |
| 4,458,680 | 07-10-1984 | Childers et al. |
| 4,602,658 | 07-29-1986 | Luther et al. |
| 4,614,186 | 09-30-1986 | John |
| 4,651,727 | 3/24/1987 | Howorth |
| 4,741,333 | 5/3/1988 | Suzuki et al. |
| 4,771,771 | 09-20-1988 | Walther |
| 4,807,614 | 02-28-1989 | van der Smissen et al. |
| 4,811,728 | 03-14-1989 | Von Kopp |
| 4,818,122 | 04/1989 | Arbuthnot |
| 4,864,654 | 09-12-1989 | Schriver et al. |
| 4,881,539 | 11/21/1989 | Pasternack |
| 4,899,740 | 02/1990 | Napolitano |
| 4,903,694 | 2/27/1990 | Hager |
| 5,003,974 | 04/1991 | Mou |
| 5,125,402 | 06/1992 | Greenough |
| 5,140,980 | 08-25-1992 | Haughey et al. |
| 5,186,165 | 02-16-1993 | Swann |
| 5,431,156 | 07-11-1995 | Sundstrom |
| 5,515,846 | 05-14-1996 | Drews |
| 5,526,804 | 06-18-1996 | Ottestad |
| 5,653,225 | 08-05-1997 | Schegerin |
| 5,690,095 | 11-25-1997 | Glynn et al. |
| 5,832,919 | 11/1998 | Kano et al. |
| 5,921,388 | 07-13-1999 | Petrilli et al. |
| 5,957,131 | 09-28-1999 | Hutchinson et al. |
| 6,014,971 | 01/2000 | Danisch et al. |
| 6,076,571 | 06-20-2000 | Burns et at. |
| 6,158,429 | 12-12-2000 | Gardner et al. |
| 6,340,024 B1 | 01-22-2002 | Brookman et al. |
| 2001/0052144 A1 | 12-20-2001 | Paris et al. |
| H1360 | 12-20-2001 | Grove et al. |
| H1316 | 06-07-1994 | McGuinness |
| H863 | 01-01-1991 | Kwiedorowicz et al. |

UNITED STATES PATENT AND TRADEMARK OFFICE

CERTIFICATE OF CORRECTION

PATENT NO. : 6,823,867 B2
APPLICATION NO. : 10/263807
DATED : November 30, 2004
INVENTOR(S) : Martin J. Avery It is certified that error appears in the above-identified patent and that said Letters Patent is hereby corrected as shown below:

Cover Page, References Cited, Foreign Patent Documents

| | | |
|---|---|---|
| GB | 2 032 255 A | 05/08/1980 |
| GB | 2 061 696 A | 05-1981 |
| WO | 86/04508 | 08-1986 |
| GB | 2 173 705 A | 10-1986 |
| EP | 0 233 995 A1 | 09-1987 |
| GB | 2 220 573 A | 01-1990 |
| EP | 0 468 188 B1 | 01-29-1992 |
| GB | 2 247 396 A | 03-1992 |
| GB | 2 247 175 | 02-26-1992 |
| EP | 0 474 372 A2 | 03-11-1992 |
| WO | 92/04835 | 04/02/1992 |
| WO | 92/09332 | 06-11-1992 |
| EP | 0 488 880 B1 | 10-11-1995 |
| EP | 0 353 417 B1 | 11-25-1992 |
| DE | 93 04 883 U1 | 06-1993 |
| WO | 01/41873 | 06-2001 |
| WO | 01/74449 Al | 10-11-2001 |
| WO | 02/11815 | 02-14-2002 |
| WO | 92/18201 | 10-29-1992 |

Cover Page, References Cited, Other Publications

"THE NEXT STEP..." 3M Innovation Brochure (2001)
"SE-SHIELD PROTECTIVE SUIT FOR SE400", downloaded from the internet archive site at
http://web.archive.org/web/*/http://www.sea.com.au/docs/data/dsseshield.htm .
According to the internet archive, this page first appeared on January 11, 2002.

Column 5
Line 28, after "pouch" insert -- 20 --.

Column 6
Line 65, after "outlet" insert -- 5 --.

Column 7
Line 44, delete "1l" and insert -- 11 --, therefor.

Column 8
Line 62, in Claim 4, after "claimed" insert -- in --.

UNITED STATES PATENT AND TRADEMARK OFFICE

CERTIFICATE OF CORRECTION

PATENT NO. : 6,823,867 B2
APPLICATION NO. : 10/263807
DATED : November 30, 2004
INVENTOR(S) : Martin J. Avery It is certified that error appears in the above-identified patent and that said Letters Patent is hereby corrected as shown below:

Column 9
Line 12, in Claim 8, delete "tie" and insert -- the --, therefor.
Line 36, in Claim 12, after "system" insert -- , --.
Line 42, in Claim 12, delete "detachbly-connected" and insert -- detachably-connected --, therefor.

Column 10
Line 4, in Claim 15, after "claimed" insert -- in --.
Line 4, in Claim 15, after "13," insert -- in --.
Line 17, in Claim 17, delete "comprises:" and insert-- comprises; --, therefor.
Line 24, in Claim 17, after "around" insert -- , --.
Line 27, in Claim 17, delete "Positioned" and insert -- positioned --, therefor.
Line 31, in Claim 17, after "that" insert -- , --.
Line 34, in Claim 17, delete "particular" and insert -- particulate --, therefor.
Line 34, in Claim 17, delete "though" and insert -- the pouch --, therefor.
Line 48, in Claim 18, delete "pouch." and insert -- pouch, --, therefor.
Line 55, in Claim 18, delete "opening" and insert -- openings --, therefor.
Line 65, in Claim 19, after "pouch" delete "as".

Column 11
Line 3, in Claim 19, delete "register" and insert -- respirator --, therefor.

Signed and Sealed this

Twenty-fourth Day of October, 2006

JON W. DUDAS
*Director of the United States Patent and Trademark Office*